US006624569B1

(12) United States Patent
Pennaz et al.

(10) Patent No.: US 6,624,569 B1
(45) Date of Patent: Sep. 23, 2003

(54) ELECTROLUMINESCENT LABELS

(75) Inventors: Thomas J. Pennaz, Champlin, MN (US); Gary R. Tucholski, N. Royalton, OH (US)

(73) Assignee: Morgan Adhesives Company, Stow, OH (US)

( * ) Notice: Subject to any disclaimer, the term of this patent is extended or adjusted under 35 U.S.C. 154(b) by 257 days.

(21) Appl. No.: 09/742,490

(22) Filed: Dec. 20, 2000

Related U.S. Application Data

(60) Provisional application No. 60/172,738, filed on Dec. 20, 1999, provisional application No. 60/172,739, filed on Dec. 20, 1999, and provisional application No. 60/172,740, filed on Dec. 20, 1999.

(51) Int. Cl.[7] ..... H01J 1/62

(52) U.S. Cl. ..... 313/505; 313/502; 313/509; 315/169.3

(58) Field of Search ..... 313/505, 506, 313/509, 502; 315/169.3

(56) References Cited

U.S. PATENT DOCUMENTS

| | | | | |
|---|---|---|---|---|
| 3,312,851 | A | 4/1967 | Flowers et al. | 313/108 |
| 3,784,414 | A | 1/1974 | Macaulay et al. | 136/175 |
| 3,889,357 | A | 6/1975 | Millard et al. | 29/570 |
| 4,064,288 | A | 12/1977 | Shah et al. | 427/58 |
| 4,105,807 | A | 8/1978 | Arora | 427/126 |
| 4,159,559 | A | 7/1979 | Robinson, Sr. | 29/25.14 |
| 4,277,974 | A | 7/1981 | Karr et al. | 73/339 |
| 4,417,174 | A | 11/1983 | Kamijo et al. | 313/502 |
| 4,624,045 | A | 11/1986 | Ishihara et al. | 29/572 |
| 4,634,934 | A | 1/1987 | Tohda et al. | 315/169 |
| 4,665,342 | A | 5/1987 | Topp et al. | 313/505 |
| 4,666,576 | A | 5/1987 | Pliefke | 204/129 |
| 4,684,353 | A | 8/1987 | deSouza | 445/51 |
| 4,721,883 | A | 1/1988 | Jacobs et al. | 313/505 |
| 4,767,965 | A | 8/1988 | Yamano et al. | 313/491 |
| 4,816,356 | A | 3/1989 | Balkanski | 429/191 |
| 4,816,717 | A | 3/1989 | Harper et al. | 313/502 |
| 4,880,661 | A | 11/1989 | Endo et al. | 427/38 |
| 4,904,901 | A | 2/1990 | Simoportos et al. | 313/509 |
| 4,936,924 | A | 6/1990 | Inuzuka | 136/249 |
| 4,977,007 | A | 12/1990 | Kondo et al. | 428/76 |

(List continued on next page.)

OTHER PUBLICATIONS

"EL Technology Provides Innovative Dashboard Lighting for Italian Sports Car" ( A Dupont application profile—H78295 3/99).
"Dupont Luxprint Electroluminescent Inks" (L 11263 11/97 Dupont Photopolymer and Electronic Materials).
"Let There Be Light: Screen Printing EL Lamps for Membrane Switches" Ken Burrows of EL Specialists Inc. as printed in the Jan. 1999 issue of "Screen Printing".
"Factors Affecting Light Output in Electrolumeniscene Lamps" Melvyn C. Rendle of Acheson Colloids presented at Jun. 28, 1999 Membrane Switch Symposium.

*Primary Examiner*—Don Wong
*Assistant Examiner*—Thuy Vinh Tran
(74) *Attorney, Agent, or Firm*—Lee, Mann, Smith, McWilliams, Sweeney & Ohlson; Timothy J. Engling

(57) ABSTRACT

The present invention is an EL lamp in the form of an adhesive label that can be mechanically and electrically connected to a surface or object through the use of conductive and non-conductive pressure sensitive adhesive (PSA). The conductive PSA is preferably pattern printed to make electrical connection with the contact of the EL lamp. The EL lamp label can be easily manufactured in large quantities on a continuous release liner provided in a roll or reel form. The EL lamp label is manufactured in large volumes and at high speeds using commercial printing, drying, laminating, punching and blanking equipment. The subsequent electrical and mechanical installation of the EL lamp label can also be performed on high speed equipment.

14 Claims, 1 Drawing Sheet

U.S. PATENT DOCUMENTS 4,983,497 A 1/1991 Gilson et al. ..... 430/272
4,999,936 A 3/1991 Calamia et al. ..... 40/544
5,013,967 A 5/1991 Hirotaka et al. ..... 313/512
5,245,516 A 9/1993 de Haas et al. ..... 362/108
5,250,905 A 10/1993 Kuo et al. ..... 324/435
5,259,778 A 11/1993 Zhang ..... 439/188
5,260,161 A 11/1993 Matsumura et al. ..... 430/161
5,264,714 A 11/1993 Nakaya et al. ..... 257/78
5,268,827 A 12/1993 Granneman et al. ..... 362/156
5,279,641 A 1/1994 Narisawa et al. ..... 75/353
5,332,946 A 7/1994 Eckersley et al. ..... 313/506
5,338,625 A 8/1994 Bates et al. ..... 429/193
5,339,024 A 8/1994 Kuo et al. ..... 324/435
5,359,261 A 10/1994 Kondo et al. ..... 313/509
5,396,177 A 3/1995 Kuo et al. ..... 324/435
5,410,217 A 4/1995 LaPointe ..... 313/509
5,411,592 A 5/1995 Ovshinsky et al. ..... 118/718
5,437,692 A 8/1995 Dasgupta et al. ..... 29/623
5,445,906 A 8/1995 Hobson et al. ..... 429/162
5,471,773 A 12/1995 Hoffman ..... 40/544
5,482,614 A 1/1996 Kondo et al. ..... 205/171
5,494,699 A 2/1996 Chung ..... 427/66
5,512,147 A 4/1996 Bates et al. ..... 204/192
5,512,389 A 4/1996 Dasgupta et al. ..... 429/192
5,533,289 A 7/1996 Hoffman ..... 40/544
5,552,668 A 9/1996 Hirose et al. ..... 313/506
5,567,210 A 10/1996 Bates et al. ..... 29/623
5,573,807 A 11/1996 LaPointe ..... 427/66
5,596,278 A 1/1997 Lin ..... 324/435
5,597,183 A 1/1997 Johnson ..... 283/83
5,598,058 A 1/1997 LaPointe ..... 313/503
5,612,152 A 3/1997 Bates ..... 429/162
5,621,274 A 4/1997 McGuigan ..... 313/512
5,621,991 A 4/1997 Gustafson ..... 40/544
5,643,685 A 7/1997 Torikoshi ..... 428/690
5,665,490 A 9/1997 Takeuchi et al. ..... 429/192
5,667,417 A 9/1997 Stevenson ..... 445/24
5,680,160 A 10/1997 LaPointe ..... 345/173
5,681,402 A 10/1997 Ichinose et al. ..... 136/256
5,726,953 A 3/1998 LaPointe et al. ..... 368/67
5,731,105 A 3/1998 Fleischer et al. ..... 429/192
5,770,920 A 6/1998 Eckersley et al. ..... 313/506
5,779,346 A 7/1998 Burke ..... 362/84
5,780,965 A 7/1998 Cass et al. ..... 313/506
5,786,664 A * 7/1998 Liu ..... 313/506
5,789,860 A 8/1998 Inoguchi et al. ..... 313/506
5,797,482 A 8/1998 LaPointe et al. ..... 200/314
5,808,412 A 9/1998 Zovko et al. ..... 313/509
5,821,691 A 10/1998 Richie et al. ..... 313/506
5,830,028 A 11/1998 Zovko et al. ..... 445/24
5,831,375 A 11/1998 Benson, Jr. ..... 313/110
5,917,278 A 6/1999 Miyauchi et al. ..... 313/506
5,958,610 A 9/1999 Yonekawa et al. ..... 428/690
6,069,442 A 5/2000 Hung et al. ..... 313/504
6,100,478 A 8/2000 LaPointe et al. ..... 200/314

* cited by examiner

ELECTROLUMINESCENT LABELS

RELATED U.S. APPLICATION DATA

This application has priority to U.S. Provisional Application Nos. 60/172,738, 60/172,739, and 60/172,740, all filed Dec. 20, 1999, and incorporated herein by reference.

BACKGROUND OF THE INVENTION

The present invention relates to electroluminescent (EL) lamps and more particularly to an EL lamp in the form of an adhesive label that can be mechanically applied and electrically connected to a surface or substrate through the use of conductive and non-conductive pressure sensitive adhesive (PSA). Adhesive labels used herein is to be broadly construed to include stickers and pressure sensitive films.

EL lamps are basically devices that convert electrical energy into light. AC current is passed between two electrodes insulated from each other and having a phosphorous material placed therebetween. Electrons in the phosphorous material are excited to a higher energy level by an electric field created between the two electrodes during the first quarter cycle of the AC voltage. During the second quarter cycle of the AC voltage, the applied field again approaches zero. This causes the electrons to return to their normal unexcited state. Excess energy is released in the form of light when these electrons return to their normal unexcited state. This process is repeated for the negative half of the AC cycle. Thus, light is emitted twice for each full cycle (Hz). Various properties of the emitted light can be controlled by varying this frequency, as well as the applied AC voltage. In general, the brightness of EL lamps increases with increased voltage and frequency.

Prior art EL lamps typically comprise numerous component layers. At the light-emitting side of an EL lamp (typically the top) is a front electrode, which is typically made of a transparent, conductive indium tin oxide (ITO) layer and a silver bus bar to deliver maximum current to the ITO. Below the ITO/bus bar layers is a layer of phosphor, followed by a dielectric insulating layer and a rear electrode layer. In some prior art EL lamps, the ITO layer is sputtered on a polyester film, which acts as a flexible substrate. A relatively thick polyester film, typically four or more mils thick is preferred because the rigidity is required for screen printing of the layers. The EL lamp construction may also include a top film laminate or coating to protect the component layers of the EL lamp construction.

The component structural layers of an EL lamp are typically made from a variety of materials. Layers are normally printed by means of a flat bed screen method and are then batch dried, except for the base substrate and top film laminate. Some of the required layers must be printed more than once in order to assure proper thickness. For example, the dielectric material needs sufficient thickness to prevent pinholes or voids, which may cause shorting between the electrodes. On the other hand, the dielectric layer is prone to cracking when multiple layers are printed one over the other. Thus, control over the printing process for the dielectric layer is extremely important. If the dielectric is too thick, the required operating voltage to achieve a given brightness will be increased as well as the chances of cracking are increased. Thus, consistent dielectric thickness in production of EL lamps is important to ensure consistent lamp brightness across a given production run of lamps.

Another limitation of a multilayer printed dielectric is the effect it has on the quality of the other component layers that are printed thereon. For example, the printed phosphor layer must be smooth and consistent to ensure a uniform lighting effect from the excited phosphor. If the multilayer printed dielectric layer is inconsistent, then the phosphor layer printed on the dielectric layer will also be inconsistent. An inconsistent printed dielectric layer will also affect other subsequently printed layers, including the transparent electrode layer. Thus, a smooth dielectric layer is important to ensure the quality of all the subsequent printed layers and ultimately the quality of the EL lamp.

Another drawback of utilizing multi-printed layers is the effect on production cycle time. Each of the printed layers of the EL lamp structure, with the exception of the base substrate and top film laminate, has to be printed and then dried before another printed layer is applied. This is a very time-consuming and expensive process, especially for printing the multilayer dielectric.

EL lamps in general, and flexible EL lamps in particular, must be easily and reliably installed in the end product or application. The EL lamp must be installed mechanically and electrically to the application. Prior art EL lamps typically treat the mechanical installation and the electrical installation separately. This typically increases manufacturing cycle times. The probability of the occurrence of manufacturing defects also increases by utilizing separate electrical and mechanical connections in the EL lamp design.

It is therefore an object of the present invention to provide an EL lamp structure in the form of an adhesive label that can be applied to a surface or object through the use of conductive and non-conductive pressure sensitive adhesive (PSA), thereby combining the electrical and mechanical installation of the EL lamp in the same manufacturing step.

It is also an object of the present invention to provide an EL lamp structure that reduces the number of printed layers by using a dielectric film in lieu of a printed dielectric layer, thus reducing the printing and drying time in the production process and increasing the reliability and quality of the EL lamp. This also eliminates the need to print on top of a thick printed dielectric layer and thereby improves the print quality of the phosphor and transparent electrode layers.

It is also an object of the present invention to provide an EL lamp structure in the form of an adhesive label that can be easily manufactured in large quantities on a continuous release liner provided in a roll or reel form.

It is also an object of this invention to provide an EL lamp structure in the form of an adhesive label that provides light from the top side as well as from the bottom side.

These and other objects and advantages of the invention will be apparent from the following description, the accompanying drawings and the appended claims.

SUMMARY OF THE INVENTION

The present invention is an EL lamp in the form of an adhesive label that can be mechanically applied and electrically connected to a surface or substrate through the use of conductive and non-conductive PSA. The EL lamp label can be easily manufactured in large quantities on a continuous release liner provided in a roll or reel form. The EL lamp label can be manufactured in large volumes and at high speeds using commercial printing, drying, laminating, punching and blanking equipment.

The EL lamp label utilizes printed structural component layers on a flexible dielectric film substrate. A phosphor layer is printed on the top of a flexible dielectric film substrate. A top transparent electrode layer, such as printable indium tin oxide (ITO), is printed on the phosphor layer. A bus bar having an electrode contact is then printed on the top transparent electrode layer. The bus bar is typically printed with silver or carbon ink or mixtures of both. A bottom electrode layer having an electrode contact is printed on the bottom of the dielectric film substrate.

A conductive pressure sensitive adhesive is applied to the electrode contact portion of the bus bar on the top of the EL lamp label and provides the necessary electrical connection for the bus bar and top electrode. A release liner can be then applied over the pressure sensitive adhesive on the electrode contact to protect the adhesive until the EL lamp label is installed. A non-conductive pressure sensitive adhesive is applied to the rear electrode layer except for the electrode contact portion. A conductive pressure sensitive adhesive is disposed on the electrode contact of the rear electrode layer and provides the necessary electrical connection for the rear electrode layer. A release liner can be then applied to the pressure sensitive adhesive on the bottom surface of the EL lamp label.

DETAILED DESCRIPTION OF THE INVENTION

While the present invention will be described fully hereinafter with reference to the accompanying drawings, in which a particular embodiment is shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

Figure 1:
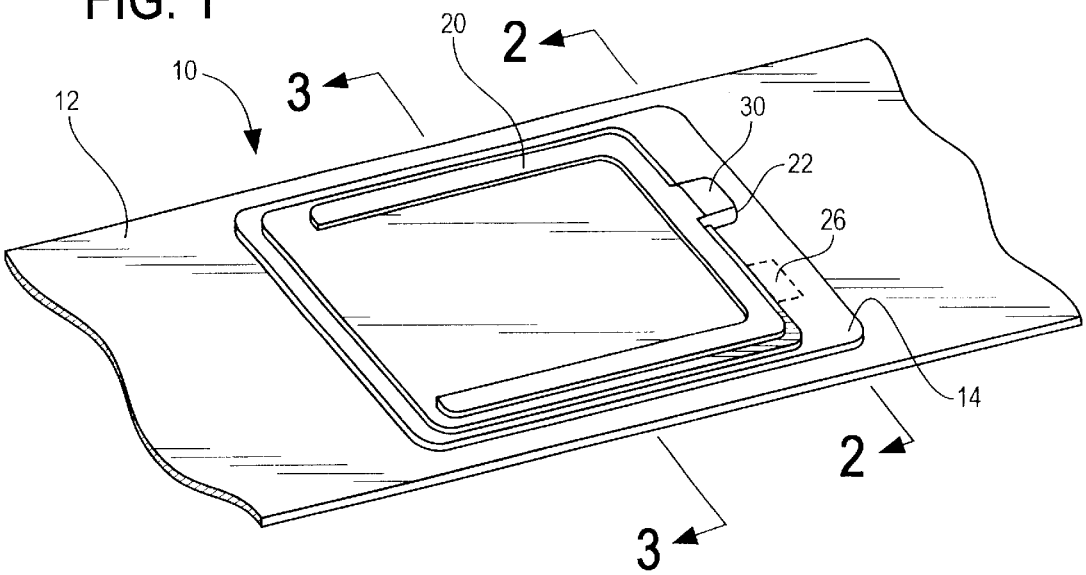
FIG. 1 is a perspective view of an EL lamp label disposed on a continuous release liner according to the present invention.

FIG. 1 shows an EL lamp label 10 constructed according to the present invention and disposed on a continuous release liner 12. As shown in the section view of FIG. 2 taken along section line 2—2 in FIG. 1, the EL lamp label 10 includes a flexible dielectric film 14, such as polypropylene, polyethylene or polyethylene terephthalate (PET), that acts as a combination dielectric layer and structural substrate for the remaining layers of the structure of the EL lamp label 10. Other films that may make acceptable dielectric films include KAPTON by E. I. Du Pont de Nemours and Co., polycarbonate polysulfone, polystyrene and impregnated film. A flexible dielectric film 14 eliminates the need for several printed dielectric layers. A PET film is preferred, but polypropylene is acceptable where the factors of film thickness and the dielectric constant are balanced to select the desired film. The flexible dielectric film 14 is rigid enough to act as a substrate. The flexible dielectric film 14 also possesses suitable dielectric properties for EL lamp applications. Depending on various design parameters, the light output will vary considerably relative to the thickness of the dielectric layer and its dielectric constant at a given operating voltage and frequency. Typically, a thicker dielectric layer will require a higher operating voltage to achieve a given lamp brightness. In any given EL lamp design, it is important to maintain an effective dielectric layer to prevent voltage breakdown between the electrodes of the EL lamp, which results in lamp malfunction and/or failure.

The remaining structure of the EL lamp is applied to the flexible dielectric film substrate 14. A layer of phosphor 16 is preferably printed on the top of the dielectric film 14. Printable phosphor compositions are available to emit light in many colors such as green, blue, or yellow. Phosphor compositions can also be blended or dyed with a fluoro dye to produce a white light. Typical EL phosphors are a zinc sulfide-based material doped with the various compounds to create the desired color. The phosphor layer 16 and other layers can be printed by rotary screen printing, flexographic printing, or other high-speed printing methods. The printed phosphor layer 16 must be smooth and consistent to ensure a uniform lighting effect from the excited phosphor. As opposed to a printed dielectric surface used in prior art structures, the dielectric film 14 provides a smooth surface for the application of the phosphor layer 16. This smooth surface promotes an evenly distributed printed phosphor layer 16 and thus provides a higher quality lighting effect.

Figure 2:
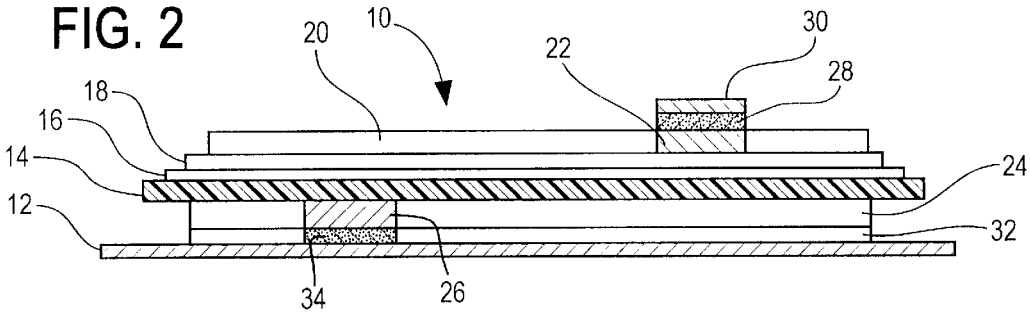
FIG. 2 is a section view taken along section line 2—2 of FIG. 1.
Figure 3:
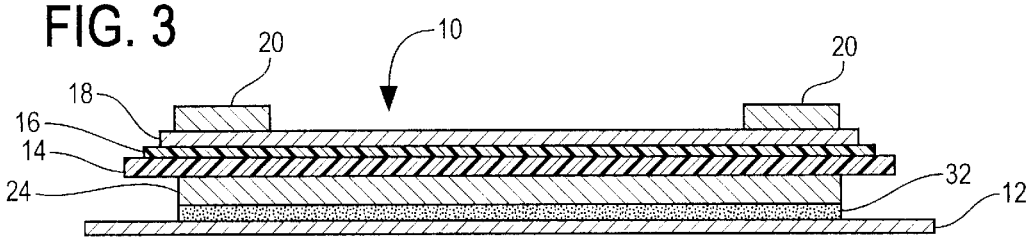
FIG. 3 is a section view taken along section line 3—3 of FIG. 1.

A top transparent electrode layer 18 is disposed on the phosphor layer 16, as shown in FIGS. 2 and 3. In a preferred embodiment, the top electrode layer 18 comprises conductive indium tin oxide (ITO). The top transparent electrode layer 18 acts as one of the two parallel conductive electrodes that create the capacitance required for the excitation of the phosphor layer 16 during operation of the EL lamp label 10. The emitted light is visible through the top transparent electrode layer 18.

A top bus bar 20 having an electrode contact 22 is preferably printed on the top transparent electrode layer 18 and provides a means for electrically connecting the transparent electrode 18. The bus bar 20 can be printed with a carbon, silver, or other conductive ink.

A bottom electrode layer 24 having an electrode contact 26 is applied on the bottom of the dielectric film 14. The bottom electrode layer 24 can be printed with silver, carbon or other conductive materials or various metalized components.

The use of a flexible dielectric film 14 in the EL lamp embodiment shown in FIGS. 2 and 3 eliminates the need for a separate dielectric layer and substrate layer in the EL lamp structure. Furthermore, the use of the dielectric film 14 also eliminates the need to dispose several printed dielectric layers on a substrate, as in prior art EL lamp structures. The elimination of these printed layers increases the quality of the dielectric layer by reducing the possibility of manufacturing defects during the printing process. Pinholes or other voids can occur in the dielectric layer if this layer is printed. These pinholes can cause electrical shorting between the transparent electrode layer 18 and the rear electrode layer 24 and result in malfunctioning or failure of the lamp. Cracking and other inconsistencies, such as inconsistent thickness, can also occur when layers are printed on top of another layer. This ultimately affects the quality of subsequently printed component layers, especially the printed phosphor layer 16. Furthermore, the elimination of several printed layers also greatly reduces the production time required to manufacture printed EL lamps. The overall production cycle time of an EL lamp is reduced due to a decrease in the required printing and drying times for each of the individual printed layers.

In an alternate embodiment of an unidirectional lamp, a low-cost commercially available flexible metalized film is used as a combination rear electrode, dielectric layer and substrate. This embodiment further reduces the number of printed component layers required in the EL lamp structure. A typical metalized film substrate has aluminum, copper, or other metallic conductive material deposited on one side of the film by sputtering, plating, printing or other metallic deposit techniques known in the art. The deposited metallic layer acts as the rear electrode and the film material, such as a polyester resin, acts as the dielectric layer. The film also acts as a substrate for application of the remaining printed component layers.

The remaining component layers are disposed on the metalized film in a fashion similar to the application of the component layers to the dielectric film 14 in the embodiment shown in FIG. 2. A phosphor layer is printed on the metalized film, and a transparent electrode layer, such as printable ITO, is then printed on the phosphor layer. A bus bar is printed on a portion of the transparent electrode layer to complete the structure of the EL lamp.

A conductive pressure sensitive adhesive (PSA) 28 is applied to the electrode contact 22 of the bus bar 20 on the top of the EL lamp label 10, as shown in FIG. 2. A release liner 30 can be then applied over the pressure sensitive adhesive 28 on the electrode contact 22 to protect the adhesive 28 until the EL lamp label 10 is installed. A non-conductive pressure sensitive adhesive 32 is applied to the bottom electrode layer 24 except for the electrode contact 26. A conductive pressure sensitive adhesive 34 is disposed on the electrode contact 26 of the rear electrode layer 24, as shown in FIG. 2. A release liner 12 can be then applied to the pressure sensitive adhesive 32 and 34 on the bottom surface of the EL lamp label 10.

A transparent laminate, lacquer, or the like 98 can be applied to a portion of the top of the EL lamp label 10 to protect the EL lamp structure from adverse environmental conditions. For obvious reasons, such a coating would not be applied at the conductive adhesive portions of the EL lamp label 10. A laminate or similar coating 98 will particularly protect the phosphor layer 16 from moisture damage. The life and light-emitting capabilities of the phosphor layer 16 are reduced by exposure to moisture. Alternately, a formulation of phosphor ink that has phosphor particles encapsulated in silica can also be used to minimize moisture damage. The silica acts as a moisture barrier and does not adversely affect the light-emitting capability of the phosphor when exposed to the electric field generated between the top transparent electrode layer 18 and the bottom electrode layer 24 of the EL lamp label 10.

Figure 4:
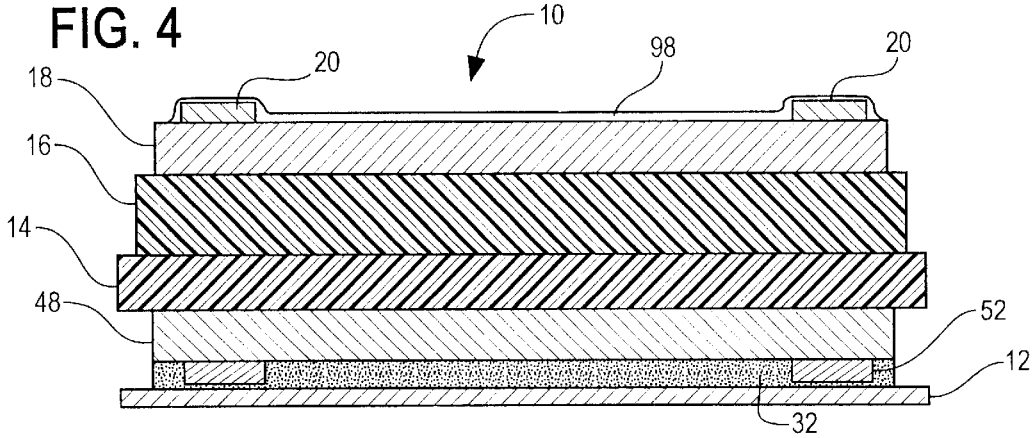
FIG. 4 is a section view of an alternate embodiment taken at a position similar section line 3—3.

In FIG. 4, another embodiment of the present invention is shown. In this embodiment, the EL lamp is two-way as shown. The EL lamp structure is applied to the flexible dielectric film substrate 14. A layer of phosphor 16 is preferably printed on the top of the dielectric film 14. Printable phosphor compositions are available to emit light in many colors such as green, blue, or yellow. Phosphor compositions can also be blended or dyed with a fluoro dye to produce a white light. Typical EL phosphors are a zinc sulfide-based material doped with the various compounds to create the desired color. The phosphor layer 16 and other layers can be printed by rotary screen printing, flexographic printing, or other high-speed printing methods. The printed phosphor layer 16 must be smooth and consistent to ensure a uniform lighting effect from the excited phosphor. As opposed to a printed dielectric surface used in prior art structures, the dielectric film 14 provides a smooth surface for the application of the phosphor layer 16. This smooth surface promotes an evenly distributed printed phosphor layer 16, and thus provides a higher quality lighting effect.

A top transparent electrode layer 18 is disposed on the phosphor layer 16, as shown in FIG. 4. In a preferred embodiment, the top electrode layer 18 comprises conductive indium tin oxide (ITO). The top transparent electrode layer 18 acts as one of the two parallel conductive electrodes that create the capacitance required for the excitation of the phosphor layer 16 during operation of the EL lamp label 10.

A top bus bar 20 having an electrode contact 22 is preferably printed on the top transparent electrode layer 18 and provides a means for electrically connecting the transparent electrode 18. The bus bar 20 can be printed with a carbon, silver, or other conductive ink.

A bottom transparent electrode layer 48 is applied on the bottom of the dielectric film 14. The bottom bus bar 52 having an electrode contact 26 can be printed with a carbon, silver, or other conductive ink. The bottom electrode layer 48 comprises conductive indium tin oxide (ITO). With this transparent electrode as well as the transparent top electrode 18, emitted light can be seen through both electrodes; thus, light can be seen from the top and bottom of this lamp label.

A conductive pressure sensitive adhesive (PSA) 28 is applied to the electrode contact 22 of the bus bar 20 on the top of the EL lamp label 10, as shown in FIG. 2. A release liner 30 can be then applied over the pressure sensitive adhesive 28 on the electrode contact 22 to protect the adhesive 28 until the EL lamp label 10 is installed. A non-conductive pressure sensitive adhesive 32 is applied to the bottom electrode layer 24 except for the electrode contact 26. A conductive pressure sensitive adhesive 34 is disposed on the electrode contact 26 of the rear bus bar layer 52, similar to FIG. 2. A release liner 12 can be then applied to the pressure sensitive adhesive 32 and 34 on the bottom surface of the EL lamp label 10.

A transparent laminate, lacquer, or the like 98 can be applied to a portion of the top of the EL lamp label 10 to protect the EL lamp structure from adverse environmental conditions. For obvious reasons, such a coating would not be applied at the conductive adhesive portions of the EL lamp label 10. A laminate or similar coating 98 will particularly protect the phosphor layer 16 from moisture damage. The life and light-emitting capabilities of the phosphor layer 16 are reduced by exposure to moisture. Alternately, a formulation of phosphor ink that has phosphor particles encapsulated in silica can also be used to minimize moisture damage. The silica acts as a moisture barrier and does not adversely affect the light-emitting capability of the phosphor when exposed to the electric field generated between the top transparent electrode layer 18 and the bottom electrode layer 24 of the EL lamp label 10.

The nominal voltage and frequency for the EL lamps described herein are typically 115 Volts (AC) and 400 Hz. However, these EL lamps can be made for operation from approximately 40–200 Volts (AC) and 50–5000 Hz. The EL lamps can be operated directly from an AC power source or from a DC power source. If a DC power source is used, such as small batteries, an inverter is required to convert the DC current to AC current. In larger applications, a resonating transformer inverter can be used. This typically consists of a transformer in conjunction with a transistor and resistors and capacitors. In smaller applications, such as placement on PC boards having minimal board component height constraints, an IC chip inverter can generally be used in conjunction with capacitors, resistors and an inductor.

Various properties of the emitted light from the EL lamp can be controlled by varying the frequency as well as the applied AC voltage. For example, the brightness of the EL lamp increases with voltage and frequency. Unfortunately, when the operating voltage and/or frequency of an EL lamp are increased, the life of the EL lamp will decrease. Therefore, in addition to various other design constraints, these properties must be balanced against the desired product life of the EL lamp to determine the proper operating voltage and/or frequency. In considering these variables, it is important to prevent voltage breakdown across the dielectric layer of the EL lamp, which results in lamp malfunction or failure.

The EL lamp label 10 can be easily manufactured in large quantities on the continuous release liner 12, which can be provided in a roll or reel form. The EL lamp label 10 can be manufactured in large volumes and at high speeds using commercial printing, drying, laminating, punching and blanking equipment.

While above-mentioned features of this invention and the manner of obtaining them may be apparent to understand the method of producing an EL label, the inventive method of manufacturing an EL label, itself, may be best understood by reference to the following description taken in conjunction with the above identified features.

A substrate film is supplied that acts as the dielectric for the EL lamp. The rear electrode of carbon, silver, or ITO ink can be reverse printed on the substrate or a conductive metalization layer can be applied, preferably before the phosphor layer is applied on the other side. A metalization layer is less expensive than a carbon or silver ink. Also, the substrate film supplied may be a metalized film with a conductive surface that is the rear electrode, dielectric layer and substrate. A conductive pressure sensitive adhesive can be applied in a pattern on the bottom surface to provide a contact with the object upon which the label is mounted. This may be in association with the contact 26 or with the appropriate conductive contact to the dielectric film 14. Similarly, a non-conductive adhesive can be pattern printed to preclude electric contact with the object upon which the label is mounted.

On the opposite surface of the film 14, phosphor can be printed on a very smooth substrate without other layers that may be potentially uneven or cracked. If necessary, a second phosphor layer may be applied. A transparent electrode (ITO) can be printed over the phosphor layer. High-speed printing methods are preferred for these layers with flexographic printing as the ideal method. A bus bar of silver or carbon is then pattern printed over the transparent electrode (s) for example in the pattern of a football goal post. A varnish can be applied or a translucent top film 98 can be laminated over the patterned bus bar and the exposed portion of the transparent electrode to encapsulate and protect the underlying components. If a top surface contact is used, a conductive PSA can be used, but the varnish must not block its conductive path. The process has been reduced to the application of three or four layers, depending on whether a second phosphor layer is applied, rather than seven or more layers of the prior art. A varnish protective layer adds another step, but is generally preferred to an overlaminate film.

Ideally, release liners are applied over the pressure sensitive adhesives to be removed when the label is applied to the appropriate object. Adhesive label that can be applied to a surface or object through the use of conductive and non-conductive PSA, thereby combining the electrical and mechanical installation of the EL lamp in the same manufacturing step.

This method of manufacturing the EL labels can be performed on high-speed equipment that may operate at speeds of more than 100 feet (30 meters) per minute on high volume commercial printing, drying, laminating, punching, and blanking equipment. This equipment replaces the flat bed screen processing of prior methods.

Such a method is suitable for high-speed processing and will require less stations and less time between steps while producing an EL lamp label that is more consistent and prone to fewer problems, such as cracking or pin holes in the dielectric. Previously problems in the dielectric were not discovered until nearly all steps of the method were completed, but in the present method the dielectric can be tested, if desired, (and certified as capacitor grade film) before layers are applied. Thereby a defective component can be removed before full processing resulting in less spoilage.

The subsequent electrical and mechanical installation of the EL lamp label can also be performed on high speed labeling equipment and will save the separate steps of physically adhering an EL lamp and electrically connecting the EL lamp to a power source.

Although the preferred embodiment of the invention is illustrated and described in connection with a particular type of components, it can be adapted for use with a variety of EL lamps. Other embodiments and equivalent EL labels and methods are envisioned within the scope of the invention. Various features of the invention have been particularly shown and described in connection with the illustrated embodiments of the invention, however, it must be understood that these particular embodiments merely illustrate and that the invention is to be given its fullest interpretation within the terms of the appended claims.

What is claimed is:

1. An electroluminescent label that can be mechanically applied and electrically connected to a surface with a pressure sensitive adhesive, the label comprising:

a flexible film functioning as a dielectric layer with a top surface and a bottom surface;

a phosphor layer on the top surface of the film;

a top transparent electrode layer on the phosphor layer;

a top bus bar with an electrode contact on a portion of the top transparent electrode layer;

a bottom electrode layer on a bottom surface of the film;

a bottom bus bar with an electrode contact on a portion of the bottom electrode layer;

a conductive pressure sensitive adhesive on the electrode contact of the bottom bus bar; and non-conductive pressure sensitive adhesive on the bottom electrode layer except for the electrode contact.

2. The electroluminescent label of claim 1 further comprising a release liner over the pressure sensitive adhesive.

3. The electroluminescent label of claim 1 further comprising transparent laminate as the top of the label.

4. The electroluminescent label of claim 1 further comprising transparent lacquer as the top of the label.

5. The electroluminescent label of claim 1 wherein the bottom electrode layer is transparent.

6. The electroluminescent label of claim 1 further comprising a conductive pressure sensitive adhesive on the electrode contact of the bus bar on the top of the label.

7. A method of making an electroluminescent label comprising the steps of:

providing a film with a smooth top surface that acts as a dielectric for the electroluminescent label and a bottom surface that includes a rear electrode;

depositing a smooth and consistent phosphor layer on the top surface of the film;

depositing a transparent electrode layer on the phosphor layer;

depositing a bus bar with an electrode contact over the transparent electrode layer in a pattern;

applying a conductive pressure sensitive adhesive on the electrode contact; and applying a non-conductive adhesive on the electrode layer except for the electrode contact.

8. The method of claim 7 wherein the layers are deposited with flexographic printing.

9. The method of claim 7 wherein the layer and bus bar are deposited by printing.

10. The method of claim 7 including an additional step of applying a release liner over the adhesive.

11. The method of claim 7 including an additional step of depositing on the rear electrode an additional bus bar.

12. The method of claim 11 including an additional step of applying a varnish over the additional bus bar and the exposed portion of the electrode to encapsulate and protect the underlying components.

13. The method of claim 11 including an additional step of laminating a translucent top film over the additional bus bar and the exposed portion of the electrode to encapsulate and protect the underlying components.

14. The method of claim 7 wherein the bottom surface of the film is a metallic layer.

* * * * *